United States Patent [19]

Deards et al.

[11] 3,987,959

[45] Oct. 26, 1976

[54] PLASTICS CARRIER-BAG

[75] Inventors: Henry Charles Deards; Nigel Evans Pickford, both of Welwyn, England

[73] Assignee: Imperial Chemical Industries Limited, London, England

[22] Filed: Aug. 12, 1974

[21] Appl. No.: 496,810

[30] Foreign Application Priority Data

Sept. 19, 1973 United Kingdom ..... 43898/73

[52] U.S. Cl. ..... 229/54 R; 150/1.7; 229/55

[51] Int. Cl.[2] ..... B65D 33/02; B65D/33/08

[58] Field of Search ..... 229/54 R, 229/53, 55; 150/DIG. 3, 1, 1.7

[56] References Cited

UNITED STATES PATENTS

| | | | |
|---|---|---|---|
| 1,467,268 | 9/1923 | Deiss | 229/55 |
| 2,272,938 | 2/1942 | Ferrante | 229/55 |
| 3,156,166 | 11/1964 | Davis | 229/54 R X |
| 3,240,420 | 3/1966 | Membrino | 229/54 R |
| 3,361,334 | 1/1968 | Terzuoli | 229/53 |
| 3,422,867 | 1/1969 | Wu | 150/1 |
| 3,514,033 | 5/1970 | Goodwin | 229/54 R |
| 3,774,837 | 11/1973 | Franson | 229/54 R |
| 3,834,528 | 9/1974 | Pickford et al. | 229/54 R |

*Primary Examiner*—Stephen P. Garbe
*Attorney, Agent, or Firm*—Cushman, Darby & Cushman

[57] ABSTRACT

A plastics carrier-bag of the type described in U.K. specification No. 1,338,934 having two-layer extensions of the front panels, the layers being sealed together by oblique seals in the corner regions, giving increased failure-resistance in the handle and other advantages.

6 Claims, 4 Drawing Figures

PLASTICS CARRIER-BAG

This invention relates to plastics carrier-bags.

The invention relates more particularly to plastics carrier-bags suitable for use in supermarkets and in other situations in which a number of packages of various weights and sizes are normally packed in a basket, bag or other container for removal by the customer. In such situations it is well known that the speed at which the goods can be removed by the customer is often considerably less than the speed at which they can be dealt with by the checker. This can result in harassment of the customer, and in increased costs through the delaying of the checker or through providing an assistant to help the customer to pack up and remove the goods.

In U.K. specification No. 1,338,934 (French Pat. No. 2,128,517) we have described a carrier-bag of plastics film or other flexible sheet material that may be formed from a substantially rectangular sheet of said material by folding and seaming, the bag comprising, in its flattened empty state: a substantially rectangular back panel; two front panels lying upon the back panel, each joined along one edge to one of a pair of opposite edges of the back panel, and each front panel extending at least a part but not substantially more than half of the distance between said opposite edges; an extension of the edge of each front panel opposite the said joined edge, each extension being backwardly folded upon the front panel to cover at least a portion thereof; a handle in or attached to each said extension; and seams extending along each of the two remaining edges of the back panel, joining together these edges of the back panel and the corresponding side edges of the front panels and extensions thereof. Such a bag will be referred to hereinafter as "a bag of the type described".

In one preferred form of a carrier-bag of the type described, each front panel extension substantially covers the front panel and is itself extended sufficiently to be then folded back towards the centre of the bag to form a further layer covering at least a major part of the first layer of the front panel extension, which thus comprises two layers, and a cut-out handle is provided in the first layer. A useful function of the additional fold and layer in the front panel extensions is to provide reinforcement in the handle regions; in use of the bag, the further layer is gathered up in the hand, above the handle. In this preferred form of the bag, the arrangement of the folds and layers is such that the bag may be easily manufactured from a folded, continuous web. The free edges of the front panel extensions in this form of the bag preferably meet at the centre of the bag.

We have now found that certain advantages may be obtained in this preferred form of a bag of the type described if the two layers of each front panel extension are joined together by heat-seals extending obliquely across at least a part of each corner region of the bag, the heat-seals preferably each lying substantially along a line extending from an end of the free edge of the front panel extension to substantially the centre of the fold between the two layers.

In accordance with the present invention, therefore, a carrier-bag of the type described, formed of plastics film and in which each front panel extension substantially covers the corresponding front panel and is itself extended and folded back towards the centre of the bag to form a second layer of the front panel extension covering at least a major part of the first layer thereof, is characterized in that these two layers in the front panel extensions are joined together by heat-seals extending obliquely at least partly across each corner of the bag. Each of these heat-seals preferably lies along a line extending substantially from an end of the edge of said second layer to the centre of the fold between the two layers.

The lines along which the said heat-seals preferably extend are the lines that may be regarded as demarcating the area within which the two layers of the front panel extensions are required to separate from one another when the bag opens fully in use. These are theoretically the lines running diagonally from the ends of the edge of the second layer of the front panel extension to the centre of the fold between the first and second layer. However, since the film will stretch somewhat under strain, especially in the handle regions, and since a part of the width of each front panel extension is gathered into the hand in a somewhat haphazard manner when the filled bag is carried, some departure from the theoretically optimum position of the seals can be tolerated. Therefore in using, to define the preferred position of the lines along which the heat-seals are located, the term "substantially from an end of the edge of said second layer to the centre of the fold between the two layers" we contemplate some departure from the exact position in each case, up to one quarter of the depth of the said second layer, and up to one quarter of the distance from the centre to an edge of the fold, respectively, each in either direction from the stated position. It is much preferred, however, that the two heat-seals at each end of the bag intersect one another at or, preferably, somewhat in advance of the fold between the two layers of the front panel extension; thus, the line of each heat-seal preferably extends obliquely across at least half the width of the bag between its seamed edges.

We have found that, by heat-sealing together the layers of the front panel extensions in the manner described, a quite unexpected improvement in the strength of the cut handle may be obtained. A further advantage is that the seals prevent small goods from being accidentally placed between the layers of the front panel extensions in areas from which they would fall out of the bag when lifted by the handles, or in which they would interfere with the correct opening-out of the bag. Another advantage is that they are helpful in locating the handles when the bag is in use.

One preferred form of the invention will now be more particularly described by way of example with reference to the accompanying drawings, of which:

Figure 1:
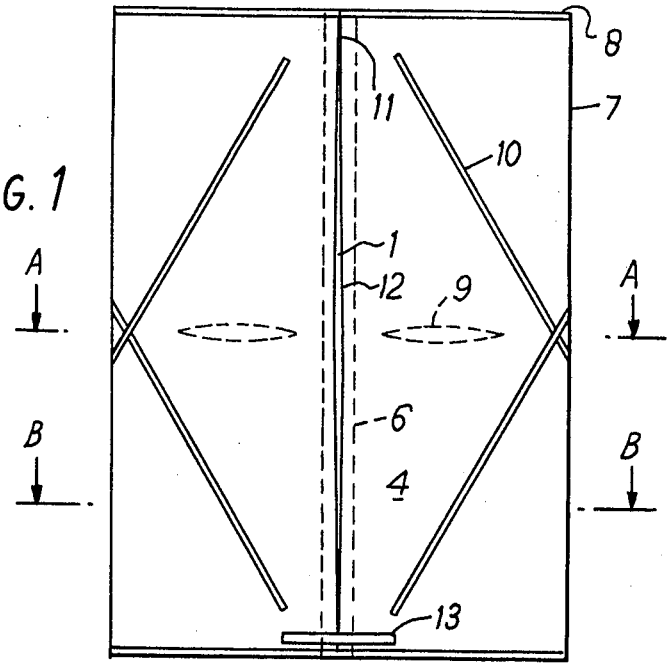
FIG. 1 is a plan of the flat, empty bag.
Figure 3:
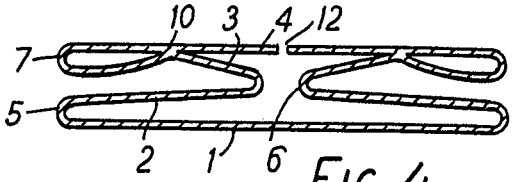
FIG. 3 is a diagrammatic section through B—B of FIG. 1.

In these Figures: 1 represents the back panel, 2 a front panel, 3 the first layer of the extension of a front panel and 4 the second layer; 5 is a fold connecting the back panel to a front panel, 6 is a fold connecting a front panel to a front panel extension, and 7 is a fold connecting the two layers of a front panel extension; 8 (FIG. 1) is a heat-seal seaming together the side edges of the back panel, the front panels and the two layers of the front panel extensions; and 9 is a slit handle (vertical in use) cut in an extension of a front panel, to provide a handle for the bag. 10, in FIGS. 1 and 3, is one of the oblique heat-seals characterizing the bag of the present invention, this seal joining together the two layers, 3 and 4, of the front panel extension along a line between one end, 11, of the free edge, 12, of the second layer 4 and the centre of the fold 7. In use, the bag is picked up at each side by passing the fingers through the hand-hole 9 and out at the centre opening of the bag, past the edge 12, and gathering up the whole width of the layer 4, together with the outer portion of layer 3 beyond the hand-hole, into the hand.

Advantageously, reinforcing tapes are adhered, parallel to the seamed edges of the bag, across the meeting (or approximately meeting) edges of the front panel extensions, at the centre of the flattened bag, adjacent to the edge seams. Such a strip is indicated at 13 in FIG. 1. Strips of adhesive tape are particularly suitable for this purpose, since they will act as shock absorbers for strains at these points; they may separate slightly from the film under heavy strain, but they will still protect the film in this area against tearing. Another method of reinforcement consists in attaching an adhesive tape along the whole length of each edge seal of the bag. Such tapes may also be used to provide printed identification or advertising matter. Generally, however, it is more economical and quite satisfactory to provide only the shorter reinforcements of adhesive tape.

As shown in FIG. 1 of the drawings, the oblique heat-seals are not necessarily extended to the seamed edges of the bag. Indeed, it is generally preferred that they stop short of these edges, to avoid the risk of weakening the heat-seals at the seamed edges in this vulnerable region. At the other end of the diagonal seals it is much preferred, as previously stated, that they intersect one another at or in advance of the fold. Any separation results in a reduction in the strength and endurance of the handle. However, compared with similar bags without the oblique seals, some statistical improvement is obtained in handle strength even when there is some such separation, and even when the heat-seals extend only along a portion of the diagonal lines, especially if they are located towards the centre of the front panel extensions. The advantages of easier location of the handle and prevention of goods from dropping between the layers are also obtained.

The effect of the oblique seals is that any tears propagated at the handle of the bag may extend to the seals, but will then follow the line of the seals until strains have been released sufficiently for tearing to cease, instead of continuing to the edge of the front panel extension and thus causing the handle to break. In general, therefore, the further the seals extend in the regions described, particularly in the region beyond the handle, the greater is the safety of the handle. Moreover, since some variation of the position of the seals may occur in the continuous production of the bags, it is preferred to design the heat-sealing operation to produce bags in which the seals intersect one another in advance of the fold.

Figure 4:
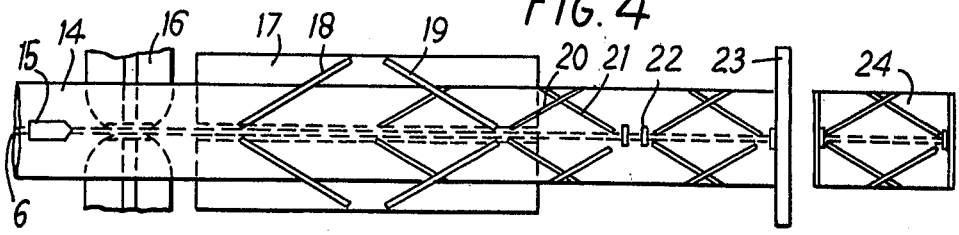
FIG. 4 is a diagrammatic representation of a method of making bags as shown in FIG. 1.

The bag of the invention may be produced by the continuous process illustrated diagrammatically by FIG. 4. In this process, a web of plastics tubular film, 14, having side gussets with folds, 6, at a depth almost equal to half the flat width of the gusseted tubing is intermittently advanced in increments of one bag length first past a slitter, 15, which centrally slits one wall of the tubing, then between handle-cutting devices, 16, by which slit handles are cut in the layer 3 (FIG. 2) at each side of the web. The slit film then advances between a pair of blades, 17, each having a resilient, heat-resistant, nonstick surface, inserted from opposite sides into the gussets. Upon these blades, during successive stationary phases of the web, two pairs of heat-sealer bars, 18, 19, seal together the two upper layers of the web at 20, 21, respectively, to form, essentially, an obtuse V-shaped seal (as shown at 10 in FIG. 1), at each side of the web in each bag length. The arms of the V-shaped seals intersect one another just inside the edge folds of the tubing, and cross the edge folds; they stop short of the internal folds of the gusset. At the next station of the web, beyond the blades 17, a pair of short lengths of adhesive tape, 22, are adhered transversely across the slit in the tubing, with a small separation between them. At the final station, a heat-sealer bar, 23, seals and severs the web transversely through all layers, and the separated bag, 24, is conveyed away to a stacking station.

In using the bag of the invention, the bag may be loaded by placing it upon a supporting surface (which preferably has a shallow, concave configuration), stacking the goods upon it, and progressively opening the bag out around the goods, by the handles, as the stack is formed. This method is described in detail in U.K. specification No. 1,338,934 (French Pat. No. 2,128,517). In another preferred method of loading, suitable for supermarket use at automated check-out points, the bag is held by each corner, ready for loading, by a device as described in Research Disclosure, 104, Dec. 1972, 25–26. By this device all layers of the bag corners are initially held, but only the uppermost two plies are securely held, the lower plies being released under load to allow the bag to open out to receive the goods. The filled bag may then be released from the clamps and carried away by its handles.

Many modifications may be made in the bag particularly described and illustrated by the drawings. For example, a cut-out handle other than a slit handle may be provided, although the straight slit is generally more convenient to make, gives a handle with a very satisfactory resistance to failure, and can combine a useful handle size (such that it can be held on the arm) with a minimum aperture for the escape of contents. The second layers of the front panel extensions preferably meet at the centre of the bag (although this is not essential) but the line of the folds beneath, between the front panels and the first layer of the extensions, may meet one another, but are preferably spaced a little from the centre line of the bag. This helps the formation of strong seals at the side edges at the centre of the bag, by graduating the changes in the number of layers in the seals.

The geometry of the bags, and the consequent dis bution of the strains, is such that the bags may be of relatively thin material to support a large load. Low-density polyethylene film is a particularly suitable material, and such film having a thickness of about 38 m$\mu$ (150 gauge film) is generally very satisfactory. The film may, of course, be printed and decorated as desired.

Figure 2:
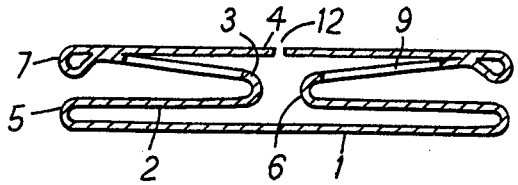
FIG. 2 is a diagrammatic section through A—A of FIG. 1.

In trials that illustrate the advantages obtainable by the construction of the bag of the present invention, a number of bags (Series A) as shown in FIGS. 1 to 3 of the drawings were made from low-density polyethylene film, 38 m$\mu$ thick, the bags being 42 cms wide and 60 cms long (giving a width:length ratio of 1:1.43). The intersecting oblique seals each extended from just beyond the centre of the fold in the front panel extension along a line through the centre of the sealed edges of the bag, but stopped short about 7 cms from the sealed edges. Another series of bags (Series B) of similar dimensions were made, with the difference that the oblique seals continued across the sealed edges of the bag. A further series of bags (Series C) differed from each only in that they had no oblique seals.

A number of bags of each type were tested by a method in which the bags, each containing a standard load, were suspended by their handles from a curved substantially hand-shaped metal support, which was vertically reciprocated, with acceleration and deceleration, in a reproducible manner. The test was continued for each bag until failure of the handle occurred. The results were as follows, the highest mean of tests on 10 bags being quoted in each case (i.e. test cycles giving a 50% probability of failure, $F_{50}$).

| Series | Bag Construction | Cycles to failure, $F_{50}$ |
|---|---|---|
| C | Standard bag | 56 |
| A | Oblique seals intersecting in vicinity of handle, and stopping short of edge seals of bag. | 1050 |
| B | As B but with oblique seals intersecting edge seals of bag. | 1025 |

We claim:

1. In a carrier-bag of flexible sheet material formed from a substantially rectangular sheet of said material by folding and seaming, the bag comprising, in its flattened, empty state 1. a substantially rectangular back panel;
2. two front panels lying upon the back panel, each joined along one edge to one of a pair of opposite edges of the back panel, and each front panel extending at least a major part but not substantially more than half of the distance between said opposite edges;
3. an extension of the edge of each front panel opposite the said joined edge, each extension being backwardly folded upon and substantially covering the front panel and each being itself extended and folded back upon itself to form a second layer covering at least a major part of the first layer thereof;
4. seams extending along each of the two remaining edges of the back panel, said seams joining together these edges of the back panel and the corresponding side edges of the front panels and extension thereof, the remaining edges and folds extending between said seams and being free across substantially their whole length;
5. a handle cut as a straight slit in the first layer only of each said extension, the slit being midway between and parallel with said seams, and ending short of the fold joining the two layers of said extension;

the improvement consisting in that in each front panel extension the two layers thereof are joined together by heat-seals extending obliquely at least partly across each corner of the bag, the two heat-seals at each end of the bag intersecting one another at or just in advance of the fold between the two layers of the front panel extension.

2. A carrier-bag as claimed in claim 1 in which each said heat-seal extends substantially from an end of the edge of said second layer to substantially the centre of the fold between the two layers.

3. A carrier-bag as claimed in claim 2 in which each said line extends obliquely across not less than half the width of the bag between its two seamed edges, and the two heat-seals at each end of the bag intersect at or just in advance of the fold between the two layers of the front panel extension.

4. A carrier-bag as claimed in claim 1 in which each said heat-seal stops short of the seamed edge of the bag.

5. A carrier-bag as claimed in claim 1 in which the second layer of the front panel extension is substantially coextensive with the first layer.

6. A carrier-bag as claimed in claim 5 in which reinforcing tapes are adhered, parallel to the seamed edges of the bag, across the meeting edges of the front panel extensions at the centre of the flattened bag, adjacent to the edge seams.

* * * * *